US005368181A

United States Patent [19]

Myers

[11] Patent Number: 5,368,181

[45] Date of Patent: Nov. 29, 1994

[54] CAPTURED DRAIN PLUG OR VENT

[76] Inventor: Alan Myers, 658 Summer View Cir., Encinitas, Calif. 92024

[21] Appl. No.: 31,210

[22] Filed: Mar. 12, 1993

[51] Int. Cl.[5] ..... B65D 51/16

[52] U.S. Cl. ..... 220/303; 220/367; 184/1.5; 222/552; 222/553; 251/216; 141/7; 141/65; 141/98

[58] Field of Search ..... 220/231, 303, 367; 222/552, 553; 251/215, 216, 217, 225; 184/1.5; 141/7, 65, 98

[56] References Cited

U.S. PATENT DOCUMENTS

| | | | |
|---|---|---|---|
| 869,853 | 10/1907 | Lamouroux | 220/367 |
| 1,228,285 | 5/1917 | Bieker | 220/367 |
| 1,830,132 | 9/1929 | Quinn | 251/216 |
| 1,993,534 | 3/1935 | Stoltz | 251/216 |
| 1,994,236 | 3/1935 | Toe Laer | 114/197 |
| 2,001,610 | 5/1935 | Hildenbrand | 251/216 |
| 2,297,830 | 10/1942 | Hardage | 251/216 X |
| 2,474,430 | 6/1949 | Laue | 251/216 |
| 3,049,334 | 8/1962 | Montague | 251/216 |
| 3,097,663 | 7/1963 | Buchwald | 251/144 |
| 3,253,963 | 5/1966 | Sabatino | 220/367 |
| 3,760,977 | 9/1973 | MacKinnon | 220/303 |
| 3,797,442 | 3/1974 | McRae | 114/183 |
| 3,811,650 | 5/1974 | Dehar | 251/217 |
| 3,866,789 | 2/1975 | Lambert | 220/303 |
| 4,815,566 | 3/1989 | Caruso | 251/216 |
| 4,905,863 | 3/1990 | Blomquist et al. | 251/216 |
| 4,986,502 | 1/1991 | Ceroke | 251/216 |
| 5,160,054 | 11/1992 | Nolte | 220/374 |

*Primary Examiner*—Allan N. Shoap
*Assistant Examiner*—Nova Stucker
*Attorney, Agent, or Firm*—Brown, Martin, Haller & McClain

[57] ABSTRACT

A plug for a threaded opening in an oil pan or other fluid container. The plug has a cylindrical midportion and upper and lower threaded portions at each end of the midportion. The midportion has a side orifice that is connected to another orifice at the end of the upper threaded portion. The end of the lower threaded portion has a grip for turning the plug. The plug may be installed by screwing the upper threaded portion into the threaded opening, sliding the plug further into the container, and screwing the lower threaded portion into the container. Fluid may be drained or vented by unscrewing the lower threaded portion and sliding the plug out of the container until the side orifice is exposed. Once unscrewed, the plug may be rotated to orient the flow of fluid from the side orifice in any direction. Fluid flow may be stopped by sliding the plug into the container until the upper edge of the lower threads contact the container wall. The upper threaded portion prevents loss of the plug during draining yet allows the plug to be easily installed in and removed from existing containers.

20 Claims, 1 Drawing Sheet

CAPTURED DRAIN PLUG OR VENT

BACKGROUND OF THE INVENTION

The present invention relates to plugs, drains, and valves for fluid containers and, more specifically, to a removable drain plug or valve.

The oil pan of an automobile engine crankcase typically has a drain plug that is screwed into a threaded drain opening in the bottom of the pan. This plug is removed to drain the used oil. Draining the oil is typically a messy and unpleasant task because oil pours forth in an uncontrolled manner as the plug is loosened and removed, often onto the hand of the person removing the plug. Not only is this procedure messy, but the person can suffer burns if the oil is hot. For the same reasons, it is undesirable to attempt to stop the flow of oil by replacing the plug.

Practitioners in the art have invented drain plugs that have remotely-operated valves, in part to address the problem of soilage of a person's hands. For example, U.S. Pat. No. 1,830,132, issued to Quinn, discloses a valve that has a rod extending upward through the crankcase that a person can rotate from above to operate the valve. Although Quinn's invention addresses the soilage problem, an existing crankcase of conventional design cannot easily be retrofitted with Quinn's invention. Furthermore, the rod cannot extend upward through conventional crankcases due to the configuration of the engine.

U.S. Pat. No. 3,049,334, issued to Montague, discloses an L-shaped drain valve attachment that can be operated from a point beneath the crankcase. A hollow screw receives oil from the crankcase through the vertical portion of the valve body and rotates in a threaded valve body within the horizontal portion of the valve body. The screw has an axial bore that terminates in an orifice. The oil drains when the orifice emerges from the valve body as the screw is rotated. Thus, the oil will begin to spout in whatever direction the orifice is oriented as soon as a portion of it emerges from the valve body. Since the orifice emerges gradually as the screw is rotated, the valve may briefly spout oil in a circular path, soiling both the underside of the automobile and the area in which the automobile is located, until the orifice can be aligned to direct the flow into the desired receptacle below the crankcase. Furthermore, excessive rotation of the screw would result in its inadvertent removal from the valve body.

A threaded plug that can be retrofitted into existing oil pans or other fluid containers, that can be used to effectively control fluid flow and direction, and that cannot be inadvertently removed would be highly desirable. These problems and deficiencies are clearly felt in the art and are solved by the present invention in the manner described below.

SUMMARY OF THE INVENTION

The present invention comprises a plug for a threaded opening in an oil pan or other fluid container. The plug has a cylindrical shank adjacent to a grip means for rotating the shank. Any type of grip means that facilitates rotation of the plug is suitable, and may include a bolt head that can be rotated with a wrench, a slotted or keyed head that can be rotated with a screwdriver or allen-type wrench, or a wing-type nut that can be rotated with fingers. The shank has threaded portions adjacent its upper and lower ends that mate with the threads of the opening in which the plug is used. The upper end of the shank has an upper orifice. The midportion of the shank, between the threaded portions, is longer than the width of the container wall at the threaded opening and has an outer diameter that is narrower than the diameter of the threaded opening. The midportion has a lower orifice that is connected to the upper orifice by a fluid conduit within the shank. The plug may be constructed from a single piece of material.

To install the plug, the upper threaded portion is screwed into the threaded opening in the container until the upper threaded portion is completely inside the container. The plug is then pushed further into the container, the midportion sliding in the threaded opening, until the lower threaded portion contacts the threads of the opening. The lower threaded portion is then screwed into the threaded opening until the plug is secure. The container may be filled with a fluid.

To drain the fluid, the lower threaded portion is unscrewed from the container. An important feature of the present invention is that the fluid does not flow from the lower orifice even after the lower threaded portion is completely unscrewed if the lower threads remain pressed snugly against the threads of the opening. In this position, with the upper edge of the lower threaded portion abutting the outer edge of the threads of the opening, the plug can be rotated to any desired orientation with substantially no fluid leakage. Then, the plug can be pulled away from the container, the midportion passing through the opening until the lower orifice is exposed, at which time the fluid flows in the direction in which the orifice is oriented. A suitable mark on the grip, aligned with the orifice, may be used to facilitate orienting the plug to direct the flow.

Although the plug can be pulled away from the container after the lower threaded portion is unscrewed, the plug cannot be pulled completely out of the container because the lower edge of the upper threaded portion abuts the inner edge of the threads of the opening. Thus, the plug cannot be lost or misplaced when draining the container. Although it is not necessary to completely remove the plug in the course of its normal use for draining fluid, the plug can if desired be completely removed from the container by engaging the threads of the upper threaded portion in the threaded opening of the container and unscrewing it.

In addition to preventing loss of the plug, the upper threaded portion provides the present invention with other important advantages over prior art drain plugs and valves. An automobile owner, for example, may substitute the present invention for a conventional oil pan screw plug without any modification to the pan or other portions of the automobile or without access to the inside of the pan. The oil pan may easily be retrofitted with the present invention. In addition, unlike prior art drain valves, no special knowledge of the location of a valve control is required to use the present invention. A mechanic may drain the oil from a position beneath the automobile using substantially the same procedures to which he is accustomed.

The foregoing, together with other features and advantages of the present invention, will become more apparent when referring to the following specification, claims, and accompanying drawings.

BRIEF DESCRIPTION OF THE DRAWING

For a more complete understanding of the present invention, reference is now made to the following detailed description of the embodiments illustrated in the accompanying drawings, wherein.

DESCRIPTION OF THE PREFERRED EMBODIMENT

Figure 1:
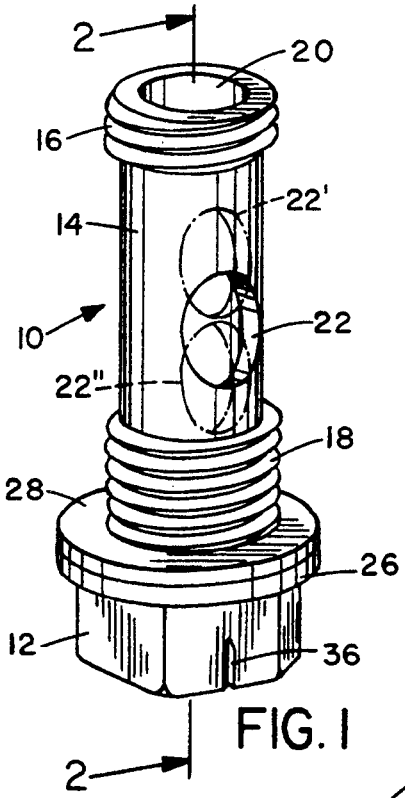
FIG. 1 is a perspective view of the drain plug.
Figure 2:
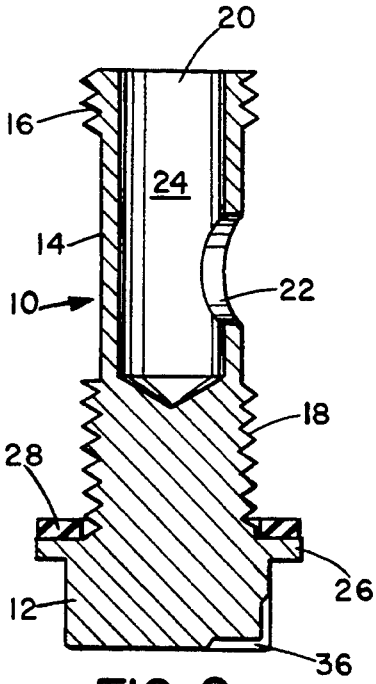
FIG. 2 is a sectional view taken along line 2—2 of FIG. 1.
Figure 3:
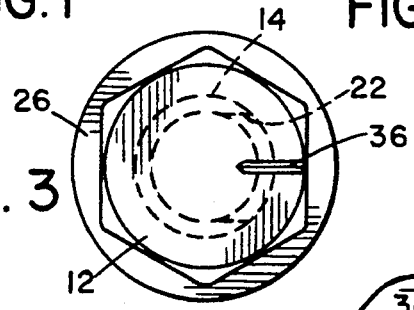
FIG. 3 is a lower end view of the drain plug.

As shown in FIGS. 1–3, the drain plug 8 of the present invention comprises a cylindrical shank 10 with a bolt head 12 at one end thereof. Shank 10 has a midportion 14, an upper threaded portion 16, and lower threaded portion 18. Upper threaded portion 16 has an upper orifice 20, and midportion 14 has a lower orifice 22. An internal conduit 24 connects upper orifice 20 to lower orifice 22. The plug may be constructed from a single piece of a suitable material such as a metal or plastic into which orifices 20 and 22 and conduit 24 may be bored or otherwise formed. A flange or collar 26 is preferably disposed between shank 10 and bolt head 12. A resilient sealing washer 28 may be disposed above collar 26.

Figure 4:
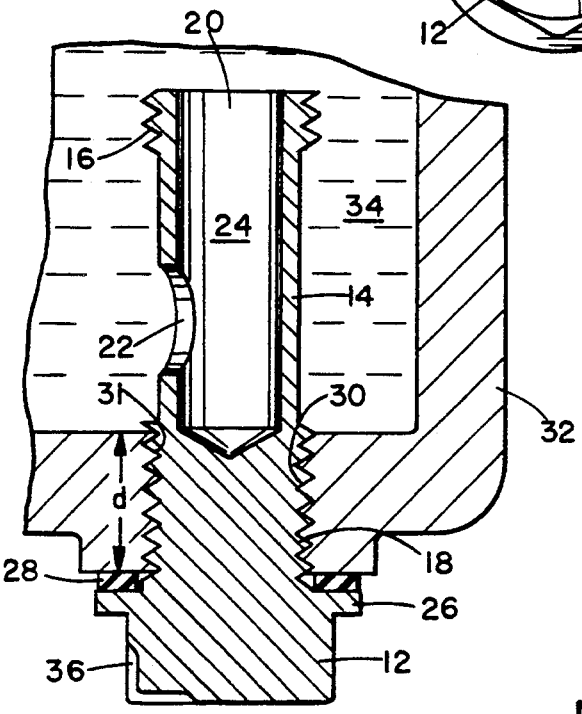
FIG. 4 is a sectional view similar to FIG. 2, showing the drain plug in the closed and sealed position.
Figure 5:
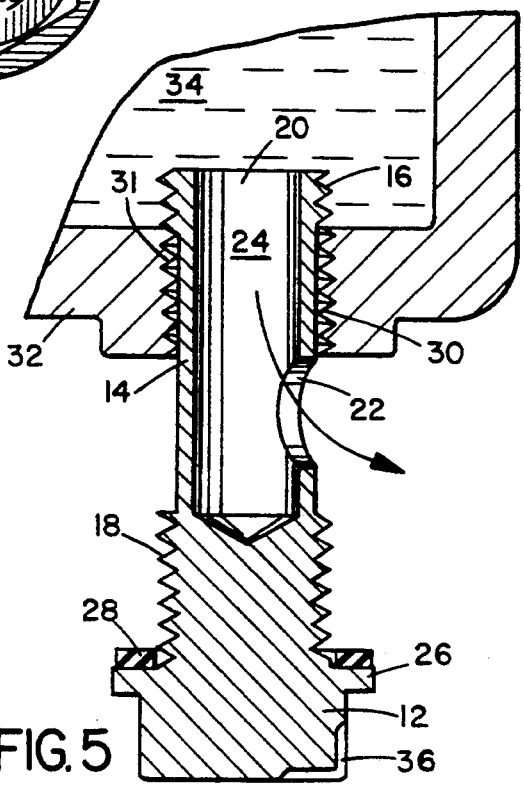
FIG. 5 is a similar view showing the drain plug in the open position.

As shown in FIGS. 4–5, the plug may be installed in the threaded opening 30 of container 32, which may be an engine oil pan, through which oil 34 is normally drained. Opening 30 has internal threads 31. The present invention is intended to be used in place of the standard drain plug (not shown) with which container 32 is normally equipped. Thus, the threading of upper and lower threaded portions 16 and 18 should mate with threads 31. Midportion 14 is longer than the thickness d of the wall of container 32 at the location of opening 30.

(For some resilient materials such as certain plastics or rubbers, the "threads" in the threaded portions 16 and 18 and the "threads" 31 will actually be a series of coaxial radial ridges around the circumference of the shank 10. Because of the resiliency of such materials such ridges function in the same manner as conventional threads for the purpose of removably retaining plug 8 in position in opening 30 and blocking the flow of fluid 34 from the interior of the container 32, at least where the pressure against the plug 8 is low. For the purposes of this invention, such ridges will be considered to be "threads" as defined herein and "unscrewing" or "turning" of threads shall be considered to include the removal or insertion of "ridged portions" as analogous to "threaded portions," and all terms such as "threads," "threaded," "unscrewing" and the like shall be deemed to apply equally to conventional helical threads as illustrated and the functionally equivalent ridges, and to analogous operations performed on both.)

Midportion 14 preferably has a substantially smooth surface and should have an outer diameter that is less than the smallest diameter of opening 30 to facilitate sliding axial movement of the plug in opening 30. Other types of surfaces such as pebbled or matte are also suitable for midportion 14.

To install the plug, upper threaded portion 16 is screwed into and through opening 30 until upper threaded portion 16 is completely inside container 32. The present invention is then pushed further into opening 30, and lower threaded portion 18 is screwed into opening 30. A wrench or screwdriver (not shown) may be used to engage the grip means 12 (here illustrated as a bolt head) to facilitate turning the plug. When lower threaded portion 18 is firmly engaged in opening 30 and flange 26 is firmly seated against the outside surface of container 32, as shown in FIG. 4, oil 34 cannot escape from container 32 because orifices 20 and 22 are inside container 32. Collar 26, which has a diameter greater than that of opening 30, prevents the plug from being screwed too far into opening 30 and, in conjunction with washer 28, prevents leakage of oil 34.

To drain oil 34 from container 32, lower threaded portion 18 is unscrewed from opening 30 until lower threaded portion 18 is completely outside container 32. If at this point the plug is further withdrawn from opening 30, oil 34 will begin to escape through lower orifice 22 as soon as a portion of lower orifice 22 is exposed to the outside of container 32. If the plug is not further withdrawn but instead the upper edge of lower threaded portion 18 is pressed against the outer edge of threads 31 of opening 30, the escape of oil 34 to the outside of container 32 will be substantially prevented. In this position, the plug can be rotated to orient lower orifice 22 in the direction in which it is desired that oil 34 flow once the plug is further withdrawn. A groove 36 or other suitable marking on grip means 12 is oriented in the same direction as lower orifice 22 and provides a visual and tactile indication of the direction in which lower orifice 22 is oriented.

The edge of lower orifice 22 nearest the upper edge of lower threaded portion 18 is preferably spaced slightly from it to reduce leakage of oil 34 while rotating the plug. However, as shown in phantom (exemplified by orifices 22′ and 22″) in FIG. 1, lower orifice 22 may be located at any point along the length of midportion 14 that allows at least a portion of lower orifice 22 to protrude outside container 32 when the lower edge of upper threaded portion 16 abuts the inner edge of threads 31 of opening 30. This spacing is an important feature of the present invention because it allows the plug to be rotated to orient lower orifice 22 in the desired direction while substantially preventing the escape of oil 34, as described above. The distance between orifice 22″ and the bottom of upper threaded portion 16 must be at least equal to the thickness d of the container 32 at the location of the opening 30.

When the plug is oriented in the desired direction it may be pulled further out of opening 30 to the position shown in FIG. 5. The force of gravity causes oil 34 to enter upper orifice 20, flow through conduit 24, and escape through lower orifice 22 to the outside of container 32.

It should be noted that the flow of oil 34 may easily be stopped before container 32 is completely drained. In contrast to the conventional screw plug commonly used in an automobile oil pan that must be aligned with and then maneuvered into opening 30 while the oil is still flowing out to stop the flow, the present invention allows a person to stop the flow and restart it again without significant leakage and resulting soilage of the person's hand and the area beneath container 32. Re-alignment of the plug with opening 30 is unnecessary because the plug has not been completely removed. As soon as the upper edge of lower threaded portion 18 abut threads 31 of opening 30, the flow of oil 34 is completely stopped. Further rotation of the plug engages the threads and secures plug in opening 30. Thus, a quick "press and turn" motion can be used to stop the flow and secure the plug at any time.

It should also be noted that once the plug is in the position shown in FIG. 5, it may be secured in opening 30 by engaging upper threaded portion 16 in threads 31. Securing the plug in this "open" position may be desirable in some situations, as described below.

Although the plug as illustrated herein is used in a threaded opening in the bottom of container 32 in the preferred embodiment, it is understood that the plug may be used in a threaded opening on any suitable type of container. It may be used in an opening on any suitable side or surface of such a container and in an opening oriented in any direction. For example, the plug may be used as a vent if placed at the top of a container. If in FIG. 5 the view were considered inverted, so that plug 8 extended upward with threaded portion 16 and threads 31 engaged, plug 8 would be held with orifice 22 outside of container 32 such that the orifices 20 and 22 and conduit 24 provide venting communication between the inside and outside of container 32.

The plug may also be used as a pressure-relief valve in a container holding a pressurized fluid. The pressurized fluid, which may be a liquid or gas, escapes between midportion 14 and threads 31 of opening 30 immediately upon disengaging lower threaded portion 18 from threads 31. The rate of pressure relief will depend on the ratio of diameter of midportion 14 to the diameter of the narrowest portion of opening 30. The plug cannot be blown out because the lower edge of upper threaded portion 16 will abut threads 31 of opening 30, thereby retaining the plug in the container.

The plug may be used not only to drain, vent, and relieve pressure in containers but also to fill them. For example, the plug may be used to fill a container by pouring a fluid into lower orifice 22. When filling a container, it may be convenient to secure the plug in the "open" position in which upper threaded portion 16 is engaged in threads 31 of opening 30.

In addition, it is anticipated that a suitable fitting (not shown) may be attached to the plug by securing it around midportion 14 to allow connection of a pipe or hose to the plug via lower orifice 22 to facilitate filling or draining the container. A pump or other equipment could then be attached to the fitting or hose. When filling or draining a container using an attached fitting, the plug may be secured in the "open" position. Midportion 14 preferably has a substantially smooth outer surface to facilitate the anticipated use of fittings.

One of the most important advantages of the present invention is that it may installed and removed in the same manner as the simple screw plug commonly used in automobile oil pans. The plug may be removed by unscrewing upper threaded portion 16 through opening 30 until it is completely outside container 32. However, complete removal of the plug is not necessary in the normal course of draining container 32. With the exception of the initial installation of the plug and its complete removal, if necessary, the primary function of upper threaded portion 16 is to retain the plug in container 32 during draining. During draining, the lower edge of upper threaded portion 16 rests against the top of opening 30, thereby preventing the plug from becoming dislodged and lost. The reduced diameter of midportion 14 also aids in preventing loss of the plug. As the fluid drains, the threads at the lower edge of upper threaded portion 16 do not continually align with threads 31 of opening 30. In order to actually remove the plug fully, the user must deliberately align these sets of threads prior to turning the plug.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A plug for a container, said container having an inside, an outside, and a threaded opening therebetween, comprising:

a substantially cylindrical shank having upper and lower threaded portions for mating with said threaded opening, and a midportion between said threaded portions, said upper threaded portion having an upper orifice in an end thereof, and said upper and lower threaded portions having the same thread pitch and pitch diameter;

grip means adjacent said lower threaded portion of said shank for facilitating rotation of said shank in said threaded opening;

said midportion having a lower orifice and a maximum diameter less than the minimum diameter of said threaded opening, at least a portion of said lower orifice extending outside said container when said upper threaded portion is disposed completely inside said container; and said shank having an internal conduit between said upper and lower orifices for communicating a fluid between said inside and said outside of said container when at least a portion of said lower orifice is disposed outside said container;

said plug thereby being prevented from unintentional release from its position in said opening once said upper threaded portion only has been threaded through said opening into said interior of said container.

2. The plug described in claim 1, wherein said lower orifice is spaced from said lower threaded portion.

3. The plug described in claim 2, wherein said spacing is sufficient for accommodating a clamping attachment.

4. The plug described in claim 1, wherein said grip means is a polygonal bolt head.

5. The plug described in claim 1, wherein said shank is made of a single piece of material.

6. The plug described in claim 1, wherein said grip means has indicia for determining the orientation of said lower orifice.

7. The plug described in claim 1, further comprising a collar between said grip means and said lower threaded portion, said collar having a diameter larger than the diameter of said threaded opening.

8. The plug described in claim 1, wherein said midportion has a substantially smooth outer surface.

9. The plug described in claim 1, wherein said container is a crankcase.

10. A plug for a container, said container having an inside, an outside, and a threaded opening therebetween, comprising:

a substantially cylindrical shank having upper and lower threaded portions for mating with said threaded opening, and a midportion between said threaded portions, said upper threaded portion having an upper orifice in an end thereof, and said upper and lower threaded portions having the same thread pitch and pitch diameter;

a polygonal bolt head adjacent said lower threaded portion of said shank for facilitating rotation of said shank in said threaded opening;

a collar between said bolt head and said lower threaded portion, said collar having a diameter larger than the diameter of said threaded opening;

said midportion of said shank having a lower orifice spaced from said lower threaded portion and a maximum diameter less than the minimum diameter of said threaded opening, said lower orifice extending outside said container when said upper threaded portion extends completely inside said container; and said shank having an internal conduit between said upper and lower orifices for communicating a fluid between said inside and said outside of said container when said lower orifice extends outside said container;

said plug thereby being prevented from unintentional release from its position in said opening once said upper threaded portion only has been threaded through said opening into said interior of said container.

11. A method for passing fluid to or from a container having an inside, an outside, and a threaded opening therebetween, comprising the steps of:

providing a substantially cylindrical plug having upper and lower threaded portions, a midportion therebetween, and a grip means adjacent said lower threaded portion, said upper threaded portion having a first orifice in an end thereof, said midportion having a second orifice connected by a conduit to said first orifice, said lower threaded portion being threadably engaged with said threaded opening and said upper threaded portion extending completely inside said container;

rotating said grip means until said lower threaded portion is threadably disengaged from said threaded opening and outside said container but an upper end of said lower threaded portion is still in contact with said threaded opening;

rotating said grip means to orient said second orifice in a selected direction;

moving said plug axially away from said threaded opening until at least a portion of said second orifice is disposed outside said container; and permitting said fluid to flow through said orifices and said conduit between said inside and said outside of said container.

12. A method as described in claim 11, wherein said moving step further comprises moving said plug axially away from said threaded opening until said upper threaded portion contacts said threaded opening.

13. A method as described in claim 11, further comprising the steps of:

determining the quantity of said fluid to be passed between said inside and said outside of said container;

upon completion of the passage of said quantity of fluid, moving said plug axially toward said threaded opening until said lower threaded portion contacts said threaded opening and said upper threaded portion is disposed completely inside said container; and rotating said grip means until said lower threaded portion is in threaded engagement with said threaded opening.

14. A method as described in claim 13, further comprising the step of continuing to rotate said grip means until said plug is fully seated in said threaded opening, whereby said container is again sealed against said passage of fluid.

15. A method as described in claim 11, wherein said plug is disposed such that when said plug is rotated to position said second orifice outside said container fluid is passed out of said container.

16. A method as described in claim 15, wherein said fluid is a liquid.

17. A method as described in claim 15, wherein said fluid is a gas.

18. A method as described in claim 11, wherein said plug is disposed such that when said plug is rotated to position said second orifice outside said container fluid is passed into said container.

19. A method as described in claim 18, wherein said fluid is a liquid.

20. A method as described in claim 18, wherein said fluid is a gas.

* * * * *